US009107016B2

(12) United States Patent
Shennib

(10) Patent No.: US 9,107,016 B2
(45) **Date of Patent: *Aug. 11, 2015**

(54) INTERACTIVE HEARING AID FITTING SYSTEM AND METHODS

(71) Applicant: iHear Medical, Inc., San Leandro, CA (US)

(72) Inventor: Adnan Shennib, Oakland, CA (US)

(73) Assignee: iHear Medical, Inc., San Leandro, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/011,581

(22) Filed: Aug. 27, 2013

(65) Prior Publication Data

US 2015/0023534 A1 Jan. 22, 2015

Related U.S. Application Data

(60) Provisional application No. 61/847,029, filed on Jul. 16, 2013.

(51) Int. Cl.
*H04R 29/00* (2006.01)
*H04R 25/00* (2006.01)

(52) U.S. Cl.
CPC ..... *H04R 25/70* (2013.01); *H04R 25/558* (2013.01); *H04R 2430/01* (2013.01)

(58) Field of Classification Search
CPC ..... H04R 25/70
USPC ..... 381/60
See application file for complete search history.

(56) References Cited

U.S. PATENT DOCUMENTS 4,759,070 A 7/1988 Voroba
5,197,332 A 3/1993 Shennib (Continued)

FOREIGN PATENT DOCUMENTS

JP 2008109594 A 5/2008
KR 1020050114861 A 12/2005

(Continued)

OTHER PUBLICATIONS

International Search Report and Written Opinion dated Nov. 3, 2010 for PCT Appl. No. PCT/US2010/048299.

(Continued)

*Primary Examiner* — Davetta W Goins
*Assistant Examiner* — Amir Etesam
(74) *Attorney, Agent, or Firm* — Dorsey & Whitney LLP

(57) ABSTRACT

Methods and systems of interactive fitting of a hearing aid by a non-expert person without resorting to a clinical setup are disclosed. The system includes an audio generator for delivering test audio signals at predetermined levels to a non-acoustic input of a programmable hearing aid in-situ. The consumer is instructed to listen to the output of the hearing device in-situ and interactively adjust fitting parameters of the programmable hearing aid according to the perceptual assessment of the hearing aid output in-situ. The output is representative of the test audio signal presented to the non-acoustic input. In one embodiment, the fitting system includes a personal computer, a handheld device communicatively coupled to the personal computer, and a fitting software application. In one embodiment, the fitting system includes an earphone for conducting a hearing evaluation.

37 Claims, 7 Drawing Sheets

(56) References Cited

U.S. PATENT DOCUMENTS

| | | | |
|---|---|---|---|
| 5,327,500 | A | 7/1994 | Campbell |
| 5,553,152 | A | 9/1996 | Newton |
| 5,645,074 | A | 7/1997 | Shennib et al. |
| 5,659,621 | A | 8/1997 | Newton |
| 5,701,348 | A | 12/1997 | Shennib et al. |
| 5,785,661 | A | 7/1998 | Shennib et al. |
| 6,137,889 | A | 10/2000 | Shennib et al. |
| 6,212,283 | B1 | 4/2001 | Fletcher et al. |
| 6,319,207 | B1 | 11/2001 | Naidoo |
| 6,359,993 | B2 | 3/2002 | Brimhall |
| 6,367,578 | B1 | 4/2002 | Shoemaker |
| 6,379,314 | B1 | 4/2002 | Horn |
| 6,428,485 | B1 | 8/2002 | Rho |
| 6,447,461 | B1 | 9/2002 | Eldon |
| 6,473,513 | B1 | 10/2002 | Shennib et al. |
| 6,522,988 | B1 | 2/2003 | Hou |
| 6,546,108 | B1 | 4/2003 | Shennib et al. |
| 6,674,862 | B1 | 1/2004 | Magilen |
| 6,724,902 | B1 | 4/2004 | Shennib et al. |
| 6,840,908 | B2 | 1/2005 | Edwards et al. |
| 6,937,735 | B2 | 8/2005 | DeRoo et al. |
| 6,940,988 | B1 | 9/2005 | Shennib et al. |
| 6,978,155 | B2 | 12/2005 | Berg |
| 7,016,511 | B1 | 3/2006 | Shennib |
| 7,037,274 | B2 | 5/2006 | Thornton et al. |
| 7,113,611 | B2 | 9/2006 | Leedom et al. |
| 7,215,789 | B2 | 5/2007 | Shennib et al. |
| 7,260,232 | B2 | 8/2007 | Shennib |
| 7,298,857 | B2 | 11/2007 | Shennib et al. |
| 7,310,426 | B2 | 12/2007 | Shennib et al. |
| 7,321,663 | B2 | 1/2008 | Olsen |
| 7,403,629 | B1 | 7/2008 | Aceti et al. |
| 7,424,123 | B2 | 9/2008 | Shennib et al. |
| 7,424,124 | B2 | 9/2008 | Shennib et al. |
| 7,580,537 | B2 | 8/2009 | Urso et al. |
| 7,664,282 | B2 | 2/2010 | Urso et al. |
| 7,854,704 | B2 | 12/2010 | Givens et al. |
| 7,945,065 | B2 | 5/2011 | Menzl et al. |
| 8,073,170 | B2 | 12/2011 | Kondo et al. |
| 8,077,890 | B2 | 12/2011 | Schumaier |
| 8,155,361 | B2 | 4/2012 | Schindler |
| 8,184,842 | B2 | 5/2012 | Howard et al. |
| 8,243,972 | B2 | 8/2012 | Latzel |
| 8,284,968 | B2 | 10/2012 | Schumaier |
| 8,287,462 | B2 | 10/2012 | Givens et al. |
| 8,379,871 | B2 | 2/2013 | Michael et al. |
| 8,396,237 | B2 | 3/2013 | Schumaier |
| 8,447,042 | B2 | 5/2013 | Gurin |
| 8,467,556 | B2 | 6/2013 | Shennib et al. |
| 8,503,703 | B2 * | 8/2013 | Eaton et al. ..... 381/312 |
| 2001/0008560 | A1 | 7/2001 | Stonikas et al. |
| 2002/0027996 | A1 | 3/2002 | Leedom et al. |
| 2002/0085728 | A1 | 7/2002 | Shennib et al. |
| 2003/0007647 | A1 | 1/2003 | Nielsen et al. |
| 2003/0078515 | A1 | 4/2003 | Menzel et al. |
| 2005/0094822 | A1 * | 5/2005 | Swartz ..... 381/56 |
| 2005/0226447 | A1 | 10/2005 | Miller,III |
| 2005/0245991 | A1 | 11/2005 | Faltys et al. |
| 2005/0259840 | A1 | 11/2005 | Gable et al. |
| 2005/0283263 | A1 | 12/2005 | Eaton et al. |
| 2006/0291683 | A1 | 12/2006 | Urso et al. |
| 2007/0076909 | A1 | 4/2007 | Roeck et al. |
| 2007/0237346 | A1 | 10/2007 | Fichtl et al. |
| 2008/0240452 | A1 | 10/2008 | Burrows et al. |
| 2008/0273726 | A1 | 11/2008 | Yoo et al. |
| 2010/0040250 | A1 | 2/2010 | Gerbert |
| 2010/0119094 | A1 | 5/2010 | Sjursen et al. |
| 2010/0145411 | A1 | 6/2010 | Spitzer |
| 2010/0239112 | A1 | 9/2010 | Howard et al. |
| 2010/0268115 | A1 | 10/2010 | Wasden et al. |
| 2010/0284556 | A1 | 11/2010 | Young |
| 2011/0058697 | A1 | 3/2011 | Shennib et al. |
| 2011/0190658 | A1 | 8/2011 | Sohn et al. |
| 2011/0200216 | A1 | 8/2011 | Lee et al. |
| 2012/0051569 | A1 | 3/2012 | Blamey et al. |
| 2012/0130271 | A1 | 5/2012 | Margolis et al. |
| 2012/0177212 | A1 | 7/2012 | Hou et al. |
| 2012/0177235 | A1 | 7/2012 | Solum |
| 2012/0183164 | A1 | 7/2012 | Foo et al. |
| 2012/0183165 | A1 | 7/2012 | Foo et al. |
| 2012/0189140 | A1 | 7/2012 | Hughes |
| 2012/0213393 | A1 | 8/2012 | Foo et al. |
| 2012/0215532 | A1 | 8/2012 | Foo et al. |
| 2012/0302859 | A1 | 11/2012 | Keefe |
| 2013/0177188 | A1 | 7/2013 | Apfel et al. |
| 2013/0243229 | A1 | 9/2013 | Shennib et al. |
| 2014/0254844 | A1 | 9/2014 | Shennib |
| 2015/0023512 | A1 | 1/2015 | Shennib |
| 2015/0023535 | A1 | 1/2015 | Shennib |
| 2015/0025413 | A1 | 1/2015 | Shennib |

FOREIGN PATENT DOCUMENTS

| | | | |
|---|---|---|---|
| WO | 99/07182 | | 2/1999 |
| WO | 2010/091480 | | 8/2010 |
| WO | 2011128462 | A2 | 10/2011 |
| WO | 2015009559 | A1 | 1/2015 |
| WO | 2015009561 | A1 | 1/2015 |
| WO | 2015009564 | A1 | 1/2015 |
| WO | 2015009569 | A1 | 1/2015 |

OTHER PUBLICATIONS

"Lyric User Guide", http://www.phonak.com/content/dam/phonak/b2b/C_M_tools/Hearing_Instruments/Lyric/documents/02-gb/Userguide_Lyric_V8_GB_FINAL_WEB.pdf, Jul. 2010.

"Methods for Calculation of the Speech Intelligibility Index", American National Standards Institute, Jun. 6, 1997.

"Specification for Audiometers", American National Standards Institute, Nov. 2, 2010.

"User Manual—2011", AMP Personal Audio Amplifiers.

Abrams, "A Patient-adjusted Fine-tuning Approach for Optimizing the Hearing Aid Response", The Hearing Review, pp. 1-8, Mar. 24, 2011.

Asha, "Type, Degree, and Configuration of Hearing Loss", American Speech-Language-Hearing Association; Audiology Information Series, May 2011, pp. 1-2.

Convery, et al., "A Self-Fitting Hearing Aid: Need and Concept", http://tia.sagepubl.com, Dec. 4, 2011, pp. 1-10.

Franks, "Hearing Measurements", National Institute for Occupational Safety and Health, Jun. 2006, pp. 183-232.

Kiessling, "Hearing aid fitting procedures—state-of-the-art and current issues", Scandinavian Audiology, 2001, 57-59, vol. 30, Suppl 52.

Nhanes, "Audiometry Procedures Manual", National Health and Nutrition Examination Survey, Jan. 2003, pp. 1-105.

Traynor, "Prescriptive Procedures", www.rehab.research.va.gov/mono/ear/traynor.htm, Jan. 1999, pp. 1-16.

World Health Organization, "Deafness and Hearing Loss",www.who.int/mediacentre/factsheets/fs300/en/index.html, Feb. 2013, pp. 1-5.

"Basic Guide to in Ear Canalphones", Internet Archive, Head-Fi.org, Jul. 1, 2012. Retrieved from http://web.archive.org/web/20120701013243/http:www.head-fi.org/a/basic-guide-to-in-ear-canalphones> on Apr. 14, 2015.

"dB HL—Sensitivity to Sound—Clinical Audiograms", Internet Archive, AuditoryNeuroscience.com, Apr. 20, 2013. Retrieved from <https://web.archive.org/web/20130420060438/http://www.auditoryneuroschience.com/ac oustics/clinical_audiograms>on Apr. 14, 2015.

"The Audiogram", Internet Archive, ASHA.org, Jun. 21, 2012. Retrieved from <https:/web.archive.org/web/20120621202942/http://www.asha.org/public/hearing/Audiogram> on Apr. 14, 2015.

(56) References Cited

OTHER PUBLICATIONS

Amlani, et al., "Methods and Applications of the Audibility Index in Hearing Aid Selection and Fitting", Trends in Amplication 6.3 (2002) 81. Retrieved from <https://www.ncbi.nim.nih.gov/pmc/articles/PMC4168961/> on Apr. 14, 2015.

International Search Report and Written Opinion for PCT/US2014/046350 mailed Nov. 6, 2014.

International Search Report and Written Opinion for PCT/US2014/046316 mailed on Nov. 3, 2014.

International Search Report and Written Opinion for PCT/US2014/046323 mailed on Oct. 10, 2014.

International Search Report and Written Opinion for PCT/US2014/046335 mailed on Nov. 3, 2014.

* cited by examiner

INTERACTIVE HEARING AID FITTING SYSTEM AND METHODS

CROSS-REFERENCE TO RELATED APPLICATIONS

This application claims the benefit under 35 U.S.C. 119 of the earlier filing date of U.S. Provisional Application 61/847,029 entitled "HEARING AID FITTING SYSTEM AND METHODS," filed Jul. 16, 2013. The aforementioned provisional application is hereby incorporated by reference in its entirety, for any purpose.

TECHNICAL FIELD

Examples described herein relate to methods and systems of hearing aid fitting, and particularly for rapidly fitting a hearing aid by a non-expert person or for self-fitting. This application is related to U.S. Pat. No. 8,467,556, titled, "CANAL HEARING DEVICE WITH DISPOSABLE BATTERY MODULE," and pending U.S. patent application Ser. No. 13/424,242, titled, "BATTERY MODULE FOR PERPENDICULAR DOCKING INTO A CANAL HEARING DEVICE," filed on Mar. 19, 2013; and Ser. No. 13/787,659, titled, "RECHARGEABLE CANAL HEARING DEVICE AND SYSTEMS," filed on Mar. 6, 2013; all of which are incorporated herein by reference in their entirety for any purpose. This application is also related to the following concurrently filed U.S. Patent Applications: Ser. No. 61/847,007, titled, "HEARING AID FITTING SYSTEMS AND METHODS USING SOUND SEGMENTS REPRESENTING RELEVANT SOUNDSCAPE," listing Adnan Shennib as the sole inventor; Ser. No. 61/847,026, titled, "HEARING PROFILE TEST SYSTEM AND METHOD," listing Adnan Shennib as the sole inventor; and Ser. No. 61/847,032, titled, "ONLINE HEARING AID FITTING SYSTEM AND METHODS FOR NON-EXPERT USER," listing Adnan Shennib as the sole inventor; all of which are also incorporated herein by reference in their entirety for any purpose.

BACKGROUND

Current hearing aid fitting systems and processes are generally complex, relying on specialized instruments for operation by hearing professionals in clinical settings. For example, a typical fitting process may include an audiometer for conducting a hearing evaluation, a program for computing prescriptive formulae, a hearing aid programming instrument to program computed fitting parameters, a real ear measurement instrument, a hearing aid analyzer, calibrated acoustic transducers, sound proof room, etc. These systems, with methods and processes associated thereto, are generally not suitable for administration by a hearing impaired consumer in home settings.

Characterization and verification of a hearing aid generally requires presenting sound stimuli to the microphone of the hearing device, referred to herein generically as a microphonic or acoustic input. The hearing aid may be worn in the ear during the fitting process, for what is referred to as "real ear measurements" (REM), or it may be placed in a test chamber for characterization by a hearing aid analyzer. Tonal sound is typically used as the primary test stimuli, but other sounds such as a synthesized speech spectrum noise, or "digital speech," may be applied to the hearing aid microphone. Real life sounds are generally not considered for determination of fitting parameters which are typically computed by a prescriptive formula. Hearing aid users are generally asked to return to the dispensing office following real-life listening experiences to make the necessary fitting adjustments for the fitting parameters. When real life sounds are used for evaluation or fitting, calibration of test sounds at the microphone of the hearing aid is generally required, involving probe tube measurements by REM instruments, or a sound level meter (SLM). Regardless of the particular method used, conventional fittings generally require clinical settings to employ specialized instruments for administration by trained professionals. The term "hearing device", is used herein to refer to all types of hearing enhancement devices, including hearing aids prescribed for the hearing impaired, and personal sound amplification products (PSAP) generally not requiring a prescription or a medical waiver.

Programmable hearing aids rely on adjustments of programmable electroacoustic settings, referred to herein generally as fitting parameters. Similar to hearing assessments and hearing aid prescriptions, the programming of a hearing aid generally requires specialized instruments and involvement of a hearing professional in a clinical setting to deal with a range of complexities related to hearing aid parameter adjustment and programming, particularly for an advanced hearing aid which may incorporate a large number of adjustable and inter-related fitting parameters.

Resorting to consumer computing devices, such as Windows-based personal computers, smartphones, and tablet computers, to produce test stimuli (sounds) for hearing evaluation is generally problematic for many reasons, including the variability in sound characteristics of output produced by consumer quality audio components. Furthermore, the internal speakers or headphone speakers used are not easily calibrated and/or simply do not meet audio specifications and standards of audiometric and hearing aid evaluations. For example total harmonic distortion (THD), accuracy of amplitudes, noise levels, frequency response, etc.

Conventional fitting processes are generally too technical and cumbersome for administration by a non-expert person. For the aforementioned reasons among others, the fitting process for a programmable hearing device is generally not available to consumers for self-administration at home. A hearing aid dispensing professional is typically required for conducting one or more steps of the fitting process, from calibrated hearing evaluation and hearing aid recommendation and selection to prescription computation and programming of the hearing device. This process often requires multiple visits to incorporate the user's subjective assessment from real life listening experiences after the initial fitting. As a result of the above, the cost of professionally dispensed hearing aids can easily reach thousands of dollars, and almost double that for a pair of advanced hearing aids. The unaffordability of programmable hearing aids represents a major barrier to potential consumers for an electronic hearing device often costing under $100 to manufacture.

SUMMARY

The present disclosure relates to methods and systems for interactive fitting of a hearing device by a non-expert user, without resorting to clinical settings and instrumentation. The fitting system comprises an audio generator for delivering calibrated test audio signals at predetermined levels to a non-acoustic input of a programmable hearing device in-situ. The test audio signals correspond to sound segments of varied sound levels and frequency characteristics. The fitting system also comprises programming interface for interactively delivering programming signals to program the hearing device in-situ. The fitting method generally involves instructing the hearing device consumer to listen to the output of the hearing device in-situ and to adjust fitting parameters by interactively delivering the test audio signal and programming signals according to the subjective assessment of the consumer to the output delivered by the hearing device in-situ. The user interface of the fitting method may be configured to allow the consumer to respond and adjust hearing aid parameters in perceptual lay terms, such as volume, loudness, audibility, clarity, and the like, rather than technical terms and complex graphical tools conventionally used by hearing professionals in clinical settings.

In some embodiments, the interactive fitting system includes a fitting device for operation with a standard personal computer configured to execute a fitting software application. The fitting device includes an audio generator configured to generate calibrated test audio signals to deliver to a non-acoustic input of a programmable hearing device in-situ. The fitting device is generally handheld-sized and may be worn on the body of the consumer or placed within the vicinity of the consumer's ear to deliver the test audio signal and programming signal to the in-situ hearing device. The fitting device also comprises programming circuitry configured to deliver programming signals to the hearing device in-situ. The fitting device in one embodiment is provided with USB connectivity for interfacing with a broad range of general personal computing devices, including smartphones and tablet computers.

In one embodiment, the fitting system further comprises an earphone configured to conduct a hearing evaluation. In another embodiment, the hearing evaluation may be conducted by delivering test acoustic signals from the hearing device, with test audio signals delivered to a non-acoustic input of the in-situ hearing device. The fitting system may include a calibrated microphone, configured to sense sound in the vicinity of the consumer.

The fitting systems and methods disclosed herein allow consumers to inexpensively and interactively test their own hearing ability, develop their own "prescription," fine tune the fitting parameters and program them into a hearing device, without resorting to specialized fitting instruments and software in a clinical setting. By delivering test audio signals directly to a non-microphonic input of the hearing device, calibration processes associated with the microphonic input of hearing aids may be eliminated. In the preferred embodiments, test audio signals and programming signals may be delivered to the input of the hearing device electrically or wirelessly.

The disclosed systems and methods allow consumers to manipulate hearing aid fitting parameters indirectly based on their audibility of hearing aid output with a predetermined level of non-acoustic input without resorting to in-situ calibration. In one embodiment, test audio signals corresponding to test audio segments are sequentially presented until all corresponding fitting parameters are adjusted according to the consumer's subjective assessment. Subsequent adjustments may be readily made to refine the fitting prescription. In the preferred embodiments, the test audio segments are substantially non-overlapping in amplitude and frequency characteristics to minimize overlap in fitting parameter control and to result in a convergent and expedited fitting process when administered by a non-expert user.

In one embodiment, the fitting system and method of use thereof enable interactive home hearing aid dispensing, reducing costs associated with professional services in clinical settings. In one embodiment, the fitting process is conducted online with hearing test and fitting applications hosted by a remote server and executed by the client computer.

BRIEF DESCRIPTION OF THE DRAWINGS

The above and still further objectives, features, aspects and attendant advantages of the present invention will become apparent from the following detailed description of various embodiments, including the best mode presently contemplated of practicing the invention, when taken in conjunction with the accompanying drawings, in which.

DETAILED DESCRIPTION

Certain details are set forth below to provide a sufficient understanding of various embodiments. Some embodiments, however, may not include all details described. In some instances, well-known structures, hearing aid components, circuits, and controls, have not been shown, in order to avoid unnecessarily obscuring the described embodiments.

Figure 2:
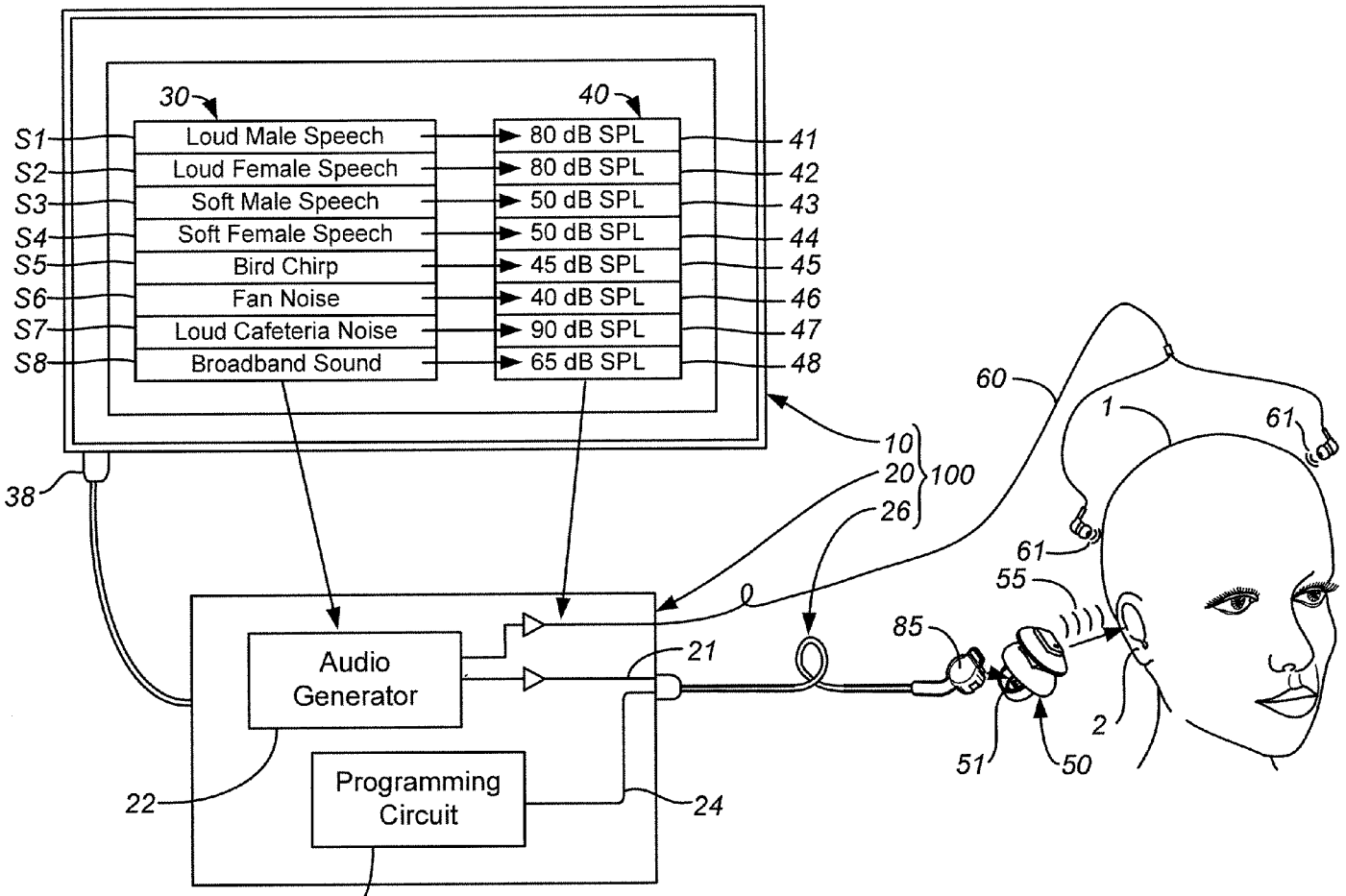
FIG. 2 is a block diagram view of the fitting system of FIG. 1 depicting example audio segments presented by the personal computer, and the handheld fitting device that includes an audio generator, programming circuit and a direct audio and programming interface to the hearing aid in-situ.
Figure 3:
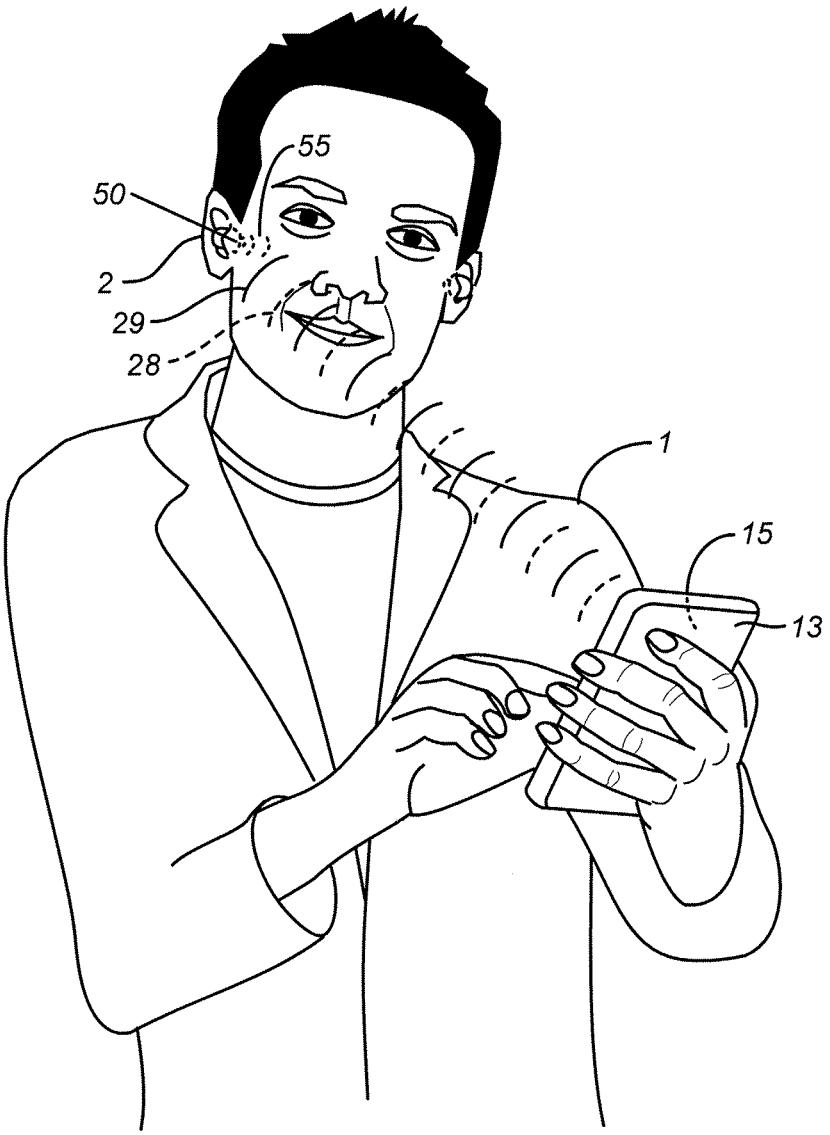
FIG. 3 is a view of an example fitting system configured to wirelessly transmit test audio signals to a non-acoustic input and programming signals from a smartphone.
Figure 4:
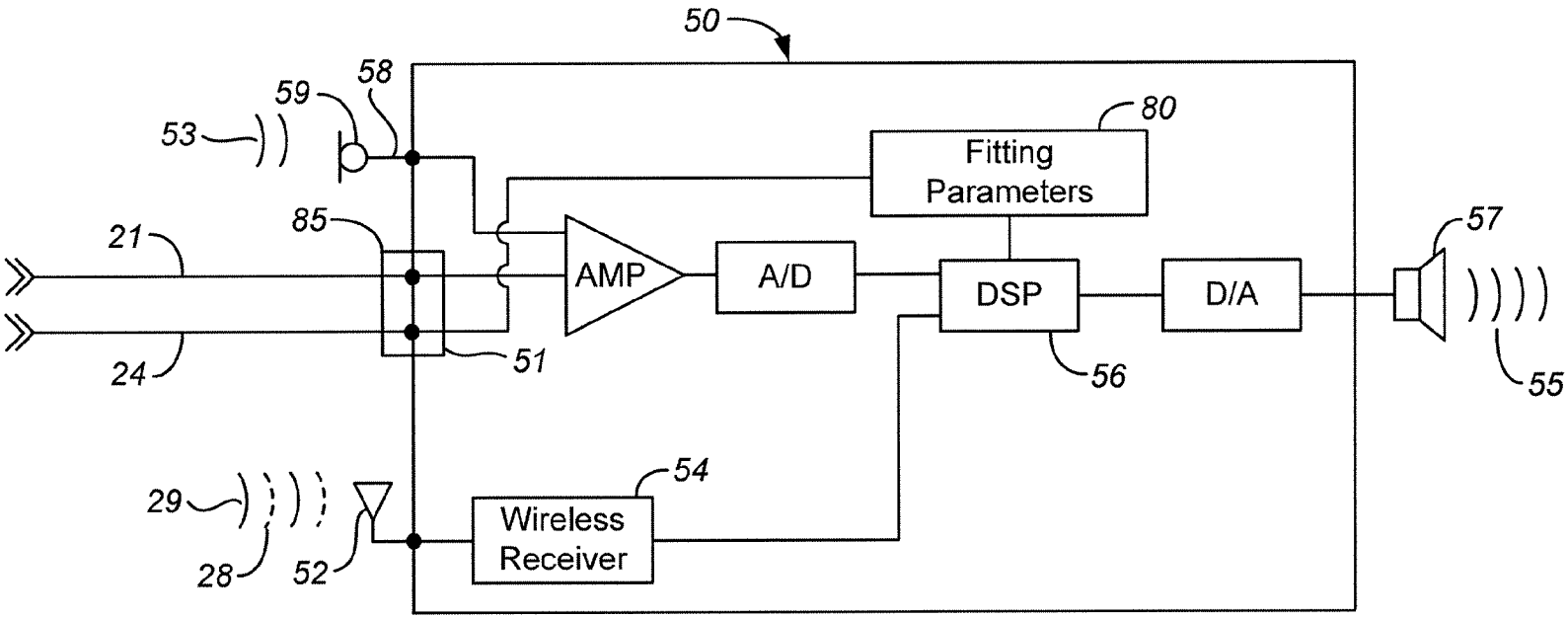
FIG. 4 is block diagram of an example programmable hearing aid, showing multiple audio input options, including microphone (acoustic) input and non-acoustic.

The present disclosure describes example systems and methods, shown in FIGS. 1-7, for interactive hearing aid fitting by a non-expert user without resorting to clinical instrumentations. In the embodiments shown in FIGS. 1 and 2, the fitting system 100 includes an audio generator 22 configured to deliver calibrated test audio signals 21 to a non-acoustic input 51 of a programmable hearing aid 50 in-situ. The test audio signals 21 correspond to test sound segments 30 (S1-S8), generally of unique and non-overlapping sound characteristics. The fitting system 100 also includes a programming circuit 23 configured to deliver programming signals 24 to program hearing aid parameters 80 into the hearing device 50 in-situ, using a fitting cable 26, or wirelessly, as will be further described below. The fitting method generally involves instructing the hearing aid consumer 1 to listen to the output 55 of the hearing device 50 in-situ and adjust controls corresponding to fitting parameters 80 (FIG. 4). The fitting process is interactive by delivering to the hearing device 50 test audio signals 21 and the programming signals 24 according to the subjective assessment and response of the consumer 1 to the output 55 of the hearing device 50 in-situ. As will be described below, the consumer 1 is offered controls generally in perceptual lay terms, such as loudness, volume, audibility, clarity, etc., instead of technical terms used in conventional fitting methods, such as compression ratio, expansion ratio, gain, attack time, etc.

In one embodiment, the fitting system 100 includes a personal computer 10, a handheld fitting device 20 communicatively coupled to the personal computer 10, and a fitting software application 12. The fitting device 20 incorporates the audio generator 22, which may be a single chip audio system. The audio generator 22 may be configured to convert digital audio files streamed from the personal computer 10 to calibrated test audio signals 21 and to deliver the calibrated test audio signals 21 to a non-acoustic input 51 (FIG. 2) of the hearing device 50 in-situ. The digital audio files may be stored in memory (not shown) of the personal computer 10 or within the fitting device 20. The fitting device 20 also includes the programming circuit 23 for delivering programming signals 24 to the hearing device 50 in-situ. The programming circuit 23 may include $I^2C$ (inter-integrated circuit) to implement $I^2C$ communications, as known in the art of electronics and programmable hearing aids. The fitting device 20 in one embodiment may be provided with USB connectivity 38 for interfacing with a broad range of general purpose personal computing devices, such as a standard personal computer 10, a smartphone 13 (FIG. 3) or a tablet computer (not shown).

Figure 1:
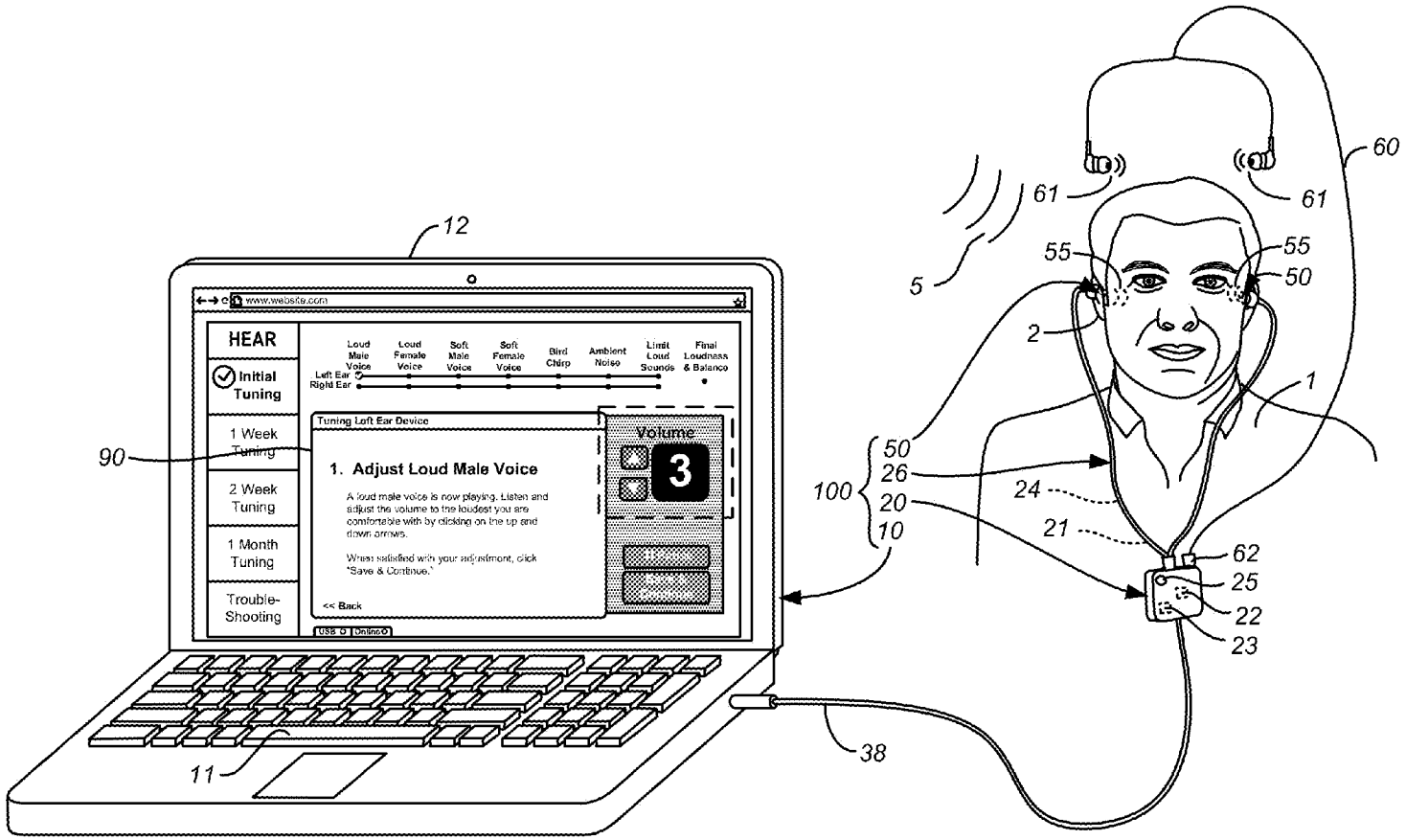
FIG. 1 is a view of an example fitting system that includes a handheld fitting device, fitting cable, a programmable hearing aid, a personal computer, and an insert earphone for conducting a hearing evaluation.

The delivery of programming signals 24, and test audio signals 21 to the non-acoustic input of the hearing device 50, may be to the electrical input 51 as shown in FIGS. 1, 2 and 4. For example, programming signals 24 and test audio signals 21 are transmitted electrically by a flexible fitting cable 26 and fitting connector 85. In one example, the fitting connector 85 may be inserted into a main module of a modular hearing device, as shown in FIG. 2, depicting the fitting connector 85 disconnected from the modular hearing device (shown larger than scale and outside of the ear 2 for the sake of clarity).

In one embodiment, the fitting system 100 includes an earphone 60 (also shown separate from the ear for the sake of clarity) coupled to the fitting device 20 via an earphone connector 62. The earphone 60 may be configured to deliver calibrated test sounds 61 at suprathreshold levels to the ear 2 for administering a hearing evaluation. The earphone 60 may comprise removable eartips (not shown) selected from an assortment according to the size or shape of the consumer's ear 2. The hearing evaluation may alternatively be conducted by delivering test audio signal 21 to the input 51 of the hearing device, as described above, and then delivering acoustic output 55 from the hearing device 50 to the consumer's ear. The delivery of the test audio input signal 21 to a non-microphonic input of the hearing device 50 may also be achieved by a wireless signal 29 to a wireless input 52. Similarly, the programming signal may be delivered wirelessly, as known in the art of wireless hearing aid programming.

FIG. 4 is a block diagram illustrating microphonic (acoustic) input vs. non-microphonic (non-acoustic) input of an example programmable hearing aid 50. The microphonic input generally refers to any signal associated with a hearing aid microphone 59, for example microphone electrical output 58, or test sound 53 presented to the hearing aid microphone 59. The non-acoustic input herein generally refers to alternate inputs which may be wired input 51 or wireless input 52. Wired input 51 may be configured to electrically receive test audio signals 21 and programming signals 24 from the handheld fitting device 20 in one example. Alternatively, a wireless input 52, in conjunction with wireless receiver 54, may be configured to receive wireless audio signals 28 and/or wireless programming signals 29 using a wireless protocol known to those skilled in the art, for example Bluetooth. One aspect of the present disclosure is employing non-acoustic input to deliver calibrated test signals, such as 21 or 28, during the fitting process. These audio signals are inherently calibrated by the nature of the signal type and medium of its conduction employed by present disclosures. For example, the level of the electrical audio signal 21, or wireless audio signal 28, is generally independent of the distance from audio generator 22, or the length of fitting cable 26, thus predictable for fitting outside clinical settings. This allows for predictable audio signal level corresponding to predictable sound segment level. The level selection is readily established by a computation by the fitting software application 12 using calibration data 40 for each sound segment and mathematical scaling as will be further described below. In contrast, delivering test sound to a microphonic input as in the prior art generally requires in-situ sound level calibration, which necessitates employing instruments and techniques not readily implementable by a non-expert person outside clinical setting. For example, to deliver an acoustic test signal 53 of 60 dB SPL at the microphone input would require a calibration measurement of the sound level at the microphone port. This can be cumbersome and limits the fitting processes with real life sounds to clinical settings and for administration by a hearing professional. FIG. 4 also shows a number of components of a typical modern hearing device, including a digital signal processor (DSP) 56, memory configured to store fitting parameters 80, and a receiver (a speaker) 57 configured to produce audible output 55 to the ear 2 of the consumer 1. In the example embodiments, the hearing device is a canal hearing device for insertion partially, substantially, or entirely into the ear canal.

Wired (e.g. electrical) and wireless non-acoustic input options may not co-exist in a typical hearing aid, but they are depicted as such in FIG. 4 merely to illustrate the various alternatives to microphonic inputs used in conventional hearing aids for fitting and hearing evaluation. By delivering test audio signals from an audio generator external to the hearing device, to a non-microphonic input of a hearing device 50, several advantages are achieved including flexibility of presenting virtually unlimited assortment of sound segment, and elimination of acoustic calibration processes associated with presenting test sound 53 at the microphone 59. For example, if a 120 μV audio signal 21 is determined to correspond to 60 dB SPL for a test sound segment 30, reference to hearing aid microphone 59, other sound levels may be readily presented by the fitting software application 12 using a proper scaling factor. For example, to present the sound segment at 80 dB SPL, the audio signal 21 may be delivered at 1.20 mV, since +20 dB corresponds to 10× factor electrically. Similar calibration correlation may readily apply to wireless audio signals 28, for example by using the appropriate scaling within the coding of digital wireless audio signals 28, or by the digital signal processor 56 (DSP). It should also be understood that scaling of input audio signal levels may also be achieved internally by hearing aid, for example by an input amplifier (AMP) or a digital signal processing 56.

FIG. 3 shows a wireless embodiment of the fitting system, whereby wireless audio signal 28 and wireless programming signal 29 are wirelessly transmitted from a smartphone 13 to implement the aforementioned teachings of the fitting process in conjunction with a wireless embodiment of the programmable hearing device 50. The wireless audio signal 28 with predetermined audio signal level is transmitted to a non-acoustic wireless input 52 of the hearing device 50, and the user 1 follows instructions presented thereto and registers audibility responses using the touch screen 15 of the smartphone 13. The hearing device fitted by the present disclosures may be of any type and configuration, including a canal hearing aid, in the ear (ITE), a receiver in the canal (RIC), or behind the ear (BTE) type.

In some embodiments, a microphone 25 may be incorporated into the fitting system 100, such as on the handheld fitting device 20 as depicted in FIG. 1, within any of the cabling (not shown), or on the personal computer 10. The microphone 25 may be generally configured to enable sensing and measuring sound 5 in the vicinity of the consumer 1, for example to measure ambient background noise level during a hearing evaluation, to ensure it is within the allowed range for proper hearing assessment, to indicate ambient noise level to the consumer 1, and to relay speech signals from the consumer 1 to a customer support person (not shown) remotely located. The microphone 25 may also be configured to detect oscillatory feedback (whistling) from the in-situ hearing aid 50. Upon detection of feedback, automatically or audibly by the consumer 1, adjustment of one or more fitting parameters 80, including a feedback cancelation parameter, may be implemented to mitigate the occurrence of feedback.

Systems and methods disclosed herein generally allow consumers to inexpensively and interactively test their own hearing ability, develop their own "prescription" including hearing aid parameters 80 into their hearing device 50, and fine tune the prescription, all without resorting to conventional methods with specialized fitting instruments and software in a clinical setting. The consumer may self-administer the fitting process from the convenience of a home or office. However, it should be understood that assistance may be provided for certain individuals, for example those with limitations related to aging, heath condition, or mental capacity.

Figure 5:
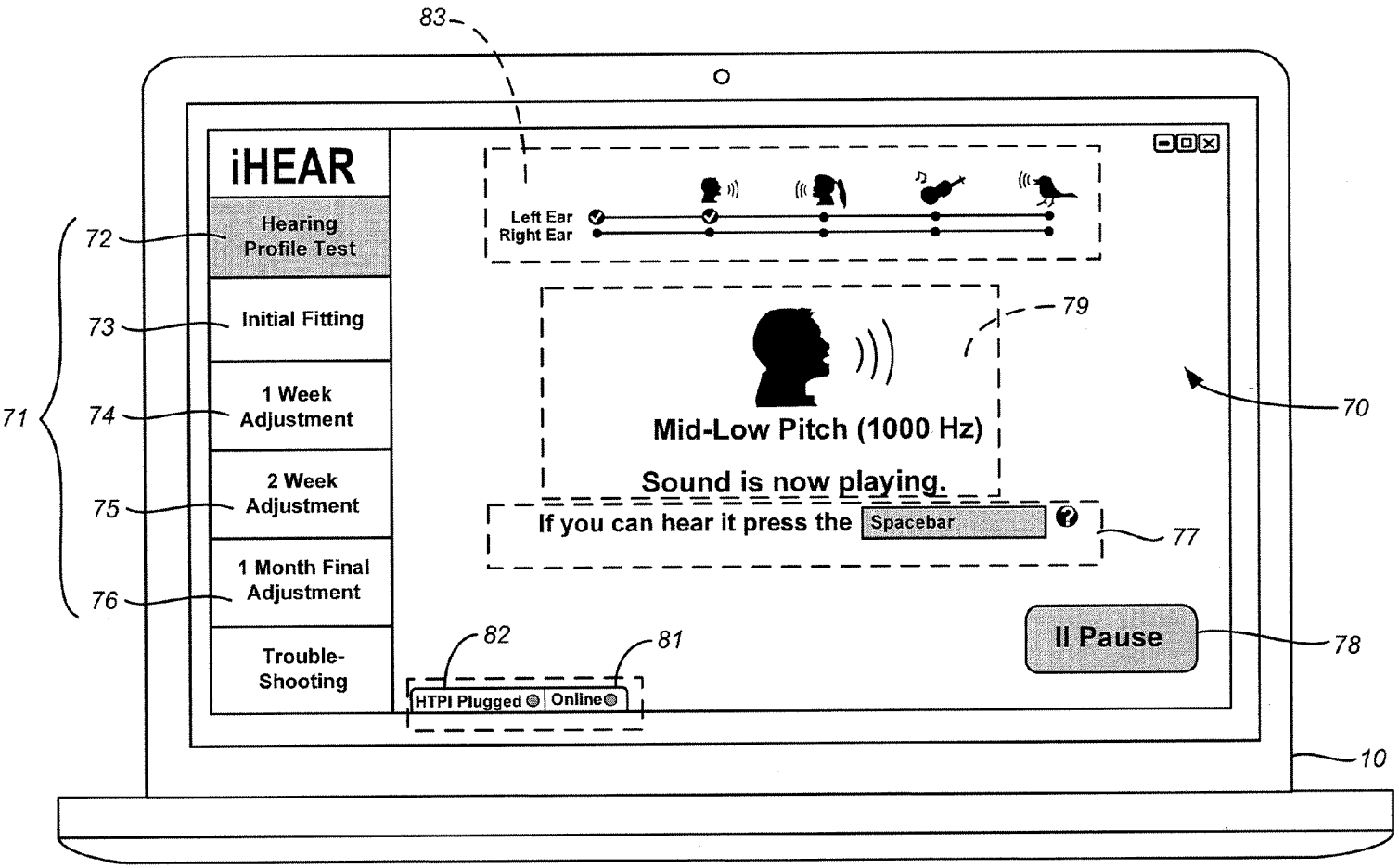
FIG. 5 is a representation of an example user interface (UI) for a hearing evaluation application, wherein the UI includes instructions, indicators, and a progress status.
Figure 6:
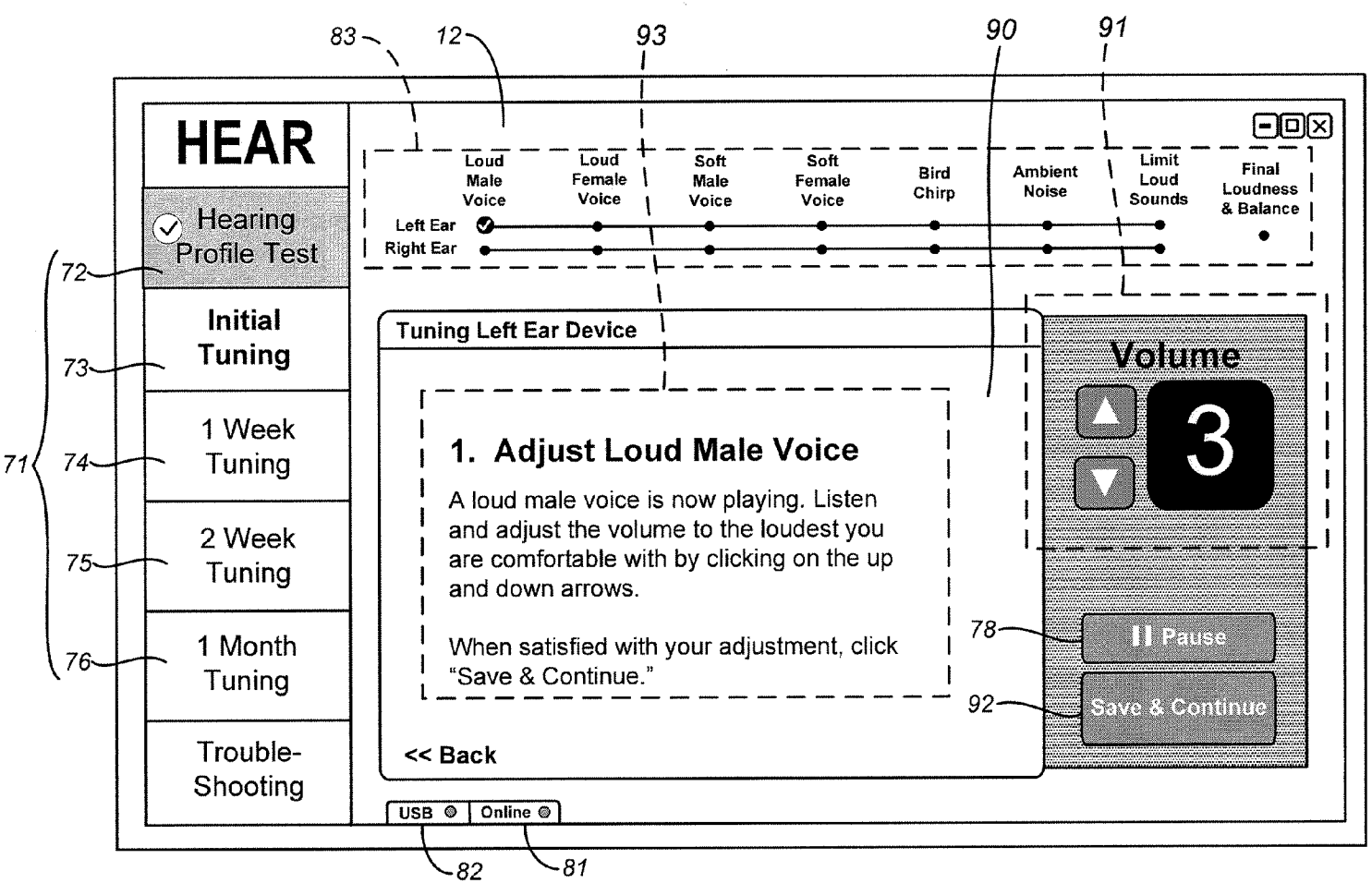
FIG. 6 is a general representation of an example UI for a hearing aid fitting application, wherein the UI includes instructions, controls, indicators, and a progress status.

FIGS. 5 and 6 show browser-based user interface (UI) embodiments for a hearing aid fitting process 71 using a generic personal computer 10 and a generic browser-enabled application to provide the functionalities described herein. The fitting process 71 may include a hearing profile test process 72, initial fitting process 73, 1-week adjustment process 74, 2-week adjustment process 75, and/or a 1-month final adjustment process 76. In the example embodiments, the fitting process is web-based and operates in conjunction with a client application, allowing access and control of the handheld fitting device 20 connected to the personal computer 10.

FIG. 5 shows an example hearing evaluation user interface 70 for the hearing profile test process 72 (a hearing evaluation) within the example fitting process 71. The hearing evaluation user interface 70 may include elements such as user instructions 77, test pause control 78, test presentation status 79, progress status 83, online connection status 81, and fitting device 20 connection status 82. The hearing evaluation user interface 70 may be configured to instruct the user 1 to listen to the test sounds 55 delivered from the output of the hearing device 50 or the test sounds 61 presented from the earphone 60, and press the space bar of the keyboard 11 (or a key on the touch screen 15) when the test sound is heard. In one embodiment, the hearing evaluation is conducted at suprathreshold levels generally exceeding 20 dB HL. An initial set of fitting parameters 80 may be computed from the results of the hearing test process 72, to enable the consumer to subsequently initiate the initial fitting process 73 described below.

FIG. 6 shows an example initial fitting user interface 90 implemented with a loudness (volume) control 91 to adjust a corresponding gain fitting parameter within the hearing device 50. Similarly, the initial fitting user interface 90 may include elements such as user instructions 93, pause control 78, save control 92, progress status 83, online connection status 81, and fitting device 20 USB connection status 82. The initial fitting user interface 90 is generally configured to instruct the user 1 to listen to the output 55 of the in-situ hearing device 50 with a relatively loud sound segment, for example S1 in FIG. 2, presented as a test audio signal 21 to a non-microphonic input 51 or 52, and to adjust the volume control 91 using the displayed arrows such that the hearing aid output 55 is perceived by the user 1 as a comfortably loud sound. Instructions to the consumer, or to a non-expert user assisting the user, may be of any suitable format, including audio instructions, text instructions, graphics, video, and live speech.

The disclosed system and methods thereof, allow adjustment of fitting parameters 80 by the consumer 1 in response to the perceptual assessment of hearing aid output 55 within the ear canal, without resorting to specialized instruments, such as a probe tube microphone inside the ear, which generally utilizes REM instrumentation to obtain an objective assessment of acoustic signals outside and within the ear canal. For example, the perceptual assessment of "Volume" (loudness) of hearing aid output 55 with "Loud Male Voice" as depicted in FIG. 6, may allow manipulation of one or more fitting parameters 80 of the hearing device 50 corresponding to loudness in the low frequency band. In one example, the consumer 1 may use the volume control 91 to increase the perceived loudness of hearing aid output 55, using an up arrow, based on a perceptual assessment that hearing aid output 55 was not sufficiently loud. In another example, the consumer 1 may use a down arrow of volume control 91 to decrease the perceived loudness of hearing aid output 55 using, based on a perceptual assessment that the hearing aid output 55 was uncomfortably loud. The perceptual assessment of the consumer 1 is generally correlated to an adjustment of one or more fitting parameters 80, which may be interactively manipulated by presenting a test audio signal 21 at a predetermined level and transmitting programming signals 24 to the hearing device 50 reflecting the adjustment being manipulated by the consumer, as described by the example process above. The computation and implementation for adjusting one or more fitting parameters 80 may be performed by a processor within the fitting system 100, for example a microprocessor within the personal computer 10 and/or a microcontroller within the fitting device 20. Other examples, shown in the progress status 83 of the initial fitting user interface 90 of FIG. 6, relate to other subjective aspects of audibility such as threshold of hearing audibility and clarity for a "Soft Female Voice" segment S4 (FIG. 2), annoyance of "Ambient Noise" using a loud cafeteria noise S7, and audibility of ultra high-frequency sound represented by a "Bird Chirp" segment S5. Fitting parameters 80 associated with the subjective aspects of audibility may be adjusted by the consumer 1 through a corresponding user interface.

Figure 7:
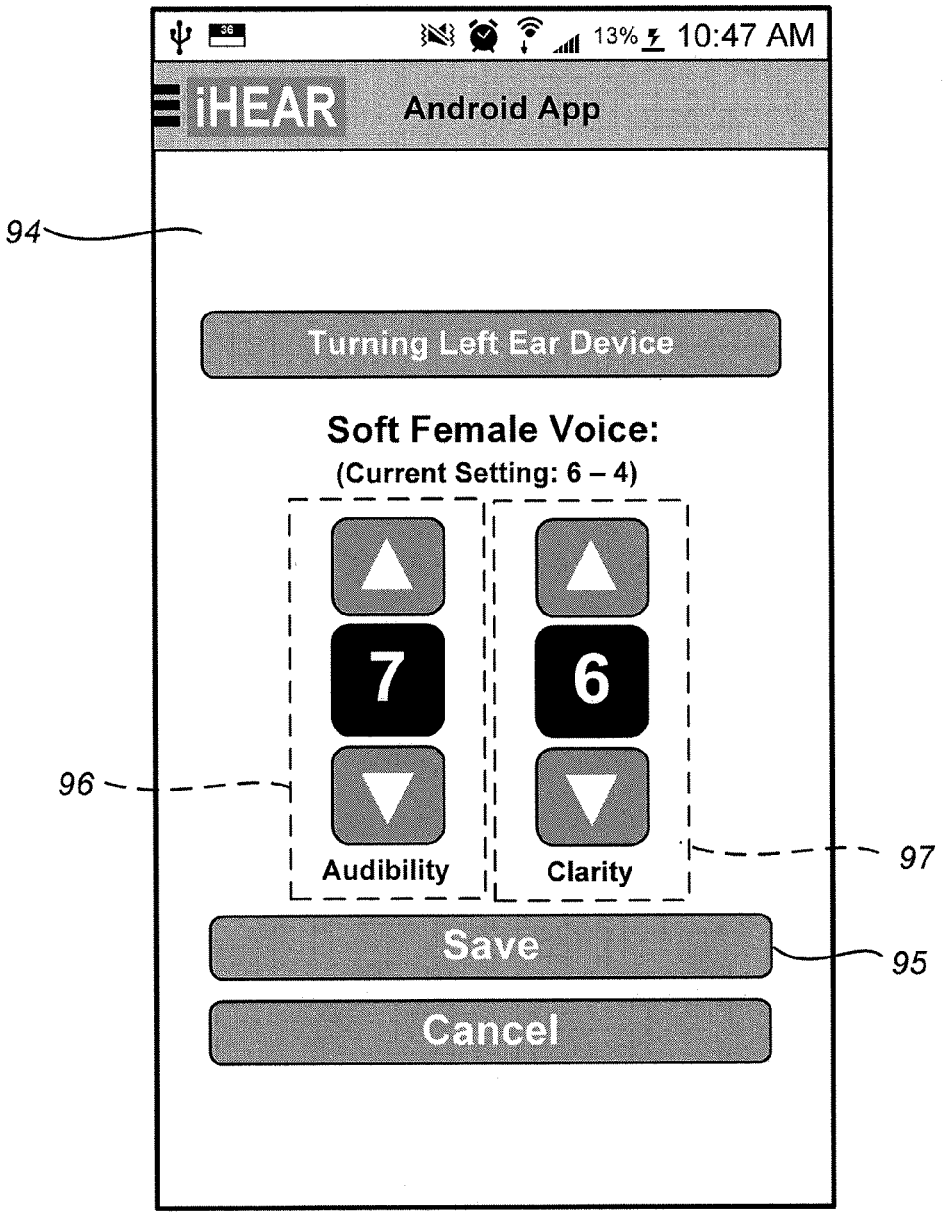
FIG. 7 is a view of an example UI for a smartphone application to adjust multiple controls and fitting parameters during the presentation of a test audio signal.

FIG. 7 shows an example smartphone fitting user interface (UI) 94 configured to allow the consumer 1 to adjust multiple fitting parameters associated with soft female speech S4 (FIG. 2), wirelessly delivered as test input signal 28 (FIG. 3) to an in-situ hearing device 50. The UI 94 may include a number of elements, for example audibility (threshold of hearing) control 96, clarity control 97, and save function control 95. The user 1 may be instructed to listen to the soft female sound segment S4 presented as test audio signal to a non-microphonic input, and to adjust controls 96 and 97 on the touch screen 15 of the smartphone 13, according to the perceptual listening experience of the user to the output 55 of the in-situ hearing device 50.

The disclosed fitting system 100 may allow consumers to manipulate complex hearing aid parameters 80 based on their subjective audibility of hearing aid output 55 with test audio segments 30 sequentially presented, for example S1-S8 in FIG. 2. The process may be repeated for each test audio segment presented until all corresponding fitting parameters 80 are adjusted according to the consumer's preference, or according to best options presented thereto. Subsequent adjustments of hearing aid features and characteristics may be readily administered after the initial fitting process 73, for example after adaptation and gaining listening experience with the hearing device 50, or after experiencing a difficult listening scenario. In some embodiments, test audio segments 30 are selected with minimal overlap in amplitude and frequency characteristics, thus minimizing overlap in parameter control and optimization, and ensuring a convergent and expedited fitting process for self-administration or when assisted by a non-expert user. It should be understood that various components of the fitting software application, such as digital audio files representing test sound segments 30, or calibration data 40 for producing predetermined levels of test sounds 41-48, may be stored within any suitable memory or location, for example within the personal computer 10, the handheld fitting device 20, remotely on a server, or generally on the Internet "cloud".

The interactive fitting system according to the aforementioned examples of hearing aid fitting process 71, including the hearing evaluation process 72, initial tuning process 73, and follow up tuning processes 74-76, may be implemented to allow the consumer 1 to be dispensed with a hearing device outside clinical settings, for example at home or work settings. Furthermore, the entire fitting process 71 may be self-administered by the consumer 1 using a consumer's personal computer 10, a fitting application that can be downloaded or executed from a generic browser, and a low-cost handheld device fitting device 20 that delivers calibrated test signals and programming signals to the input of a hearing device 50 configured to receive the test audio signals directly to a non-acoustic input thereof. This arrangement allows for eliminating the cost and process complexities associated with professional instrumentations and services in clinical settings. In one embodiment, the fitting process 71 is substantially conducted online, with hearing fitting applications hosted by a remote server and executed by a personal computer 10.

Although examples of the invention have been described herein, variations and modifications of the described embodiments may be made, without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A handheld device for interactively fitting a programmable hearing device, the handheld device comprising:

an audio signal generator configured to deliver test audio input signals corresponding to sound segments at predetermined suprathreshold loudness levels to a non-acoustic audio input of the programmable hearing device in-situ; and a programming interface configured to deliver a programming signal to the programmable hearing device in-situ and to program fitting parameters of the programming hearing device in-situ, wherein the programmable hearing device is configured to deliver an acoustic output representative of the test audio input signals and according to the fitting parameters, and wherein the handheld device is configured to deliver the programming signal interactively to adjust plurality of the fitting parameters according to a perceptual assessment of a consumer listening to the acoustic output of the programmable hearing device in-situ, wherein the adjustments comprise a first adjustment made to one or more fitting parameters corresponding to a relatively loud level sound and a second adjustment made to one or more fitting parameters corresponding to a relatively soft level sound.

2. The handheld device of claim 1, wherein the audio signal generator is configured to deliver test audio input signals to an earphone to administer a hearing evaluation.

3. The handheld device of claim 1, wherein the programming interface comprises $I^2C$.

4. The handheld device of claim 1, wherein the programming signal is delivered to the programmable hearing device electrically by an electrical cable.

5. The handheld device of claim 1, wherein the programming interface is configured to wirelessly deliver the programming signal to a wireless receiver within the programmable hearing device.

6. The handheld device of claim 1 comprising a microphone configured to sense sound in the vicinity of the consumer.

7. The handheld device of claim 1, wherein the test audio signals are electrically delivered to the non-acoustic audio input.

8. The handheld device of claim 1, wherein the test audio input signals are wirelessly delivered to the non-acoustic audio input.

9. The handheld device of claim 1, wherein the handheld device is communicatively coupled to a personal computer.

10. The handheld device of claim 9, wherein the handheld device is communicatively coupled to the personal computer by a USB connector.

11. A system for fitting a programmable hearing device, the system comprising:

a programmable hearing device comprising a non-acoustic audio input configured to receive at least one audio input signal corresponding to a sound segment at a predetermined suprathreshold loudness level and deliver an audible output in-situ, wherein the audible output is representative of the audio input signal according to fitting parameters programmed into the programmable hearing device;

an audio signal generator configured to deliver of the at least one audio input signal, wherein at least one audio input signal is delivered to the non-acoustic audio input;

an ear phone configured to receive at least one audio input signal from the audio signal generator and deliver calibrated test sounds to a consumer's ear;

a programming interface configured to deliver programming signals to the programmable hearing device in-situ; and a personal computer configured to execute a fitting application to allow adjustment of a plurality of the fitting parameters according to a subjective assessment by the consumer listening to the audible output from the programmable hearing device in-situ, wherein the adjustments comprise a first adjustment made to one or more fitting parameters corresponding to a relatively loud level sound and a second adjustment made to one or more fitting parameters corresponding to a relatively soft level sound.

12. The system of claim 11, further comprising a microphone configured to sense sound in a vicinity of the consumer's ear.

13. The system of claim 11, wherein the programming signal is electrically delivered to the programmable hearing device by an electrical cable.

14. The system of claim 11, wherein the programming interface is configured to wirelessly deliver the programming signal to a wireless receiver of the programmable hearing device.

15. The system of claim 11, wherein the at least one audio input signal is electrically delivered to the non-acoustic audio input of the programmable hearing device.

16. The system of claim 11, wherein the at least one audio input signal is wirelessly delivered to the non-acoustic audio input of the programmable hearing device.

17. The system of claim 11, wherein the earphone comprises a removable eartip selected from an assortment according to the size of the consumer's ear canal.

18. The system of claim 11, wherein the personal computer is selected from the group consisting of a smartphone and a tablet computer.

19. A method of interactively fitting a programmable hearing device for a hearing device consumer, the method comprising:

delivering audio input signals corresponding to sound segments at predetermined suprathreshold loudness levels by a fitting system to a non-acoustic audio input of the programmable hearing device in-situ;

delivering an acoustic output from the programmable hearing device in-situ, wherein the acoustic output is representative of the audio input signals, according to fitting parameters programmed into the programmable hearing device;

adjusting a plurality of the fitting parameters of the programmable hearing device in-situ, according to a subjective assessment by the consumer listening to the acoustic output, wherein the adjustments comprise a first adjustment made to one or more fitting parameters corresponding to a relatively loud level sound and a second adjustment made to one or more fitting parameters corresponding to a relatively soft level sound; and delivering a programming signal from the fitting system to the programmable hearing device to implement the adjustment of at least one of the fitting parameters of the programmable hearing device.

20. The method of claim 19, further comprising providing instruction to the consumer by the fitting system.

21. The method of claim 20, wherein the instruction is presented in a format selected from the group consisting of audio, text, graphics, video, speech, and combinations thereof.

22. The method of claim 20, wherein the instruction is provided by delivering audio signal to a non-microphonic input of the programmable hearing device in-situ.

23. The method of claim 19, wherein the fitting system comprises a handheld device.

24. The method of claim 19, wherein the fitting system comprises a personal computer.

25. The method of claim 19, comprising sensing a sound present in a vicinity of the consumer using a microphone incorporated in the fitting system.

26. The method of claim 25, wherein the sound is selected from the group consisting of ambient background sound, speech of the consumer, oscillatory feedback emanating from the programmable hearing device in-situ.

27. The method of claim 19, further comprising mitigating oscillatory feedback by adjusting at least one of the fitting parameters of the programmable hearing device.

28. The method of claim 19, wherein at least one of the steps of the method is self-administered by the hearing device consumer.

29. The method of claim 19, wherein at least one of the steps of the method are administered by a non-expert person assisting the hearing device consumer.

30. A method of fitting a programmable hearing device for a hearing device consumer using a fitting system, the method comprising:

administering a hearing test by delivering acoustic test signals corresponding to sound segments at predetermined suprathreshold loudness levels from the fitting system to an ear of the consumer;

delivering test audio input signals from the fitting system to a non-acoustic audio input of the programmable hearing device in-situ;

delivering an output from the programmable hearing device in-situ to the ear of the consumer, wherein the output is representative of the test audio input signals, according to fitting parameters programmed into the programmable hearing device;

adjusting a plurality of the fitting parameters by the fitting system according to a subjective response of the consumer to the output from the programmable hearing device, wherein the adjustments comprise a first adjustment made to one or more fitting parameters corresponding to a relatively loud level sound and a second adjustment made to one or more fitting parameters corresponding to a relatively soft level sound; and delivering a programming signal from the fitting system to implement an adjustment of at least one of the fitting parameters.

31. The method of claim 30, wherein the fitting system comprises a handheld device.

32. The method of claim 30, wherein the fitting system comprises a personal computer.

33. The method of claim 30, further comprising sensing a sound in a vicinity of the consumer using a microphone incorporated within the fitting system.

34. The method of claim 33, wherein the fitting system is configured to regulate delivery of acoustic test signals according to the sound in the vicinity of the consumer.

35. The method of claim 30, further comprising computing at least some of the fitting parameters by the fitting systems based on results of the hearing test.

36. The method of claim 30, wherein at least one of the steps of the method is self-administered by the hearing device consumer.

37. The method of claim 30, wherein at least one of the steps of the method is administered by a non-expert person assisting the hearing device consumer.

* * * * *